US005323129A

United States Patent [19]

Harris

[11] Patent Number: 5,323,129

[45] Date of Patent: Jun. 21, 1994

[54] RESONATOR MOUNTING APPARATUS

[75] Inventor: James M. Harris, Terrell, Tex.

[73] Assignee: Gardiner Communications Corporation, Garland, Tex.

[21] Appl. No.: 819,273

[22] Filed: Jan. 10, 1992

[51] Int. Cl.[5] ..... H01P 7/10

[52] U.S. Cl. ..... 333/219.1; 333/227

[58] Field of Search ..... 333/202, 219.1, 219, 333/235, 227; 331/96, 107 DP

[56] References Cited

U.S. PATENT DOCUMENTS

| | | | |
|---|---|---|---|
| 3,973,226 | 8/1976 | Affolter et al. | 333/202 |
| 4,028,652 | 6/1977 | Wakino et al. | 333/235 X |
| 4,318,064 | 3/1982 | Kach | 333/202 |
| 4,580,116 | 4/1986 | Ballato | 333/234 |
| 4,602,229 | 7/1986 | Yester, Jr. et al. | 333/208 |
| 4,639,690 | 1/1987 | Lewis | 331/96 |
| 4,661,790 | 4/1987 | Gannon et al. | 333/202 X |
| 4,733,198 | 3/1988 | Blickstein et al. | 331/96 |
| 4,818,956 | 4/1989 | Stajcer | 331/96 |
| 4,939,489 | 7/1990 | Gueble et al. | 333/202 |
| 4,963,841 | 10/1990 | Sparagna | 333/202 |
| 5,027,090 | 6/1991 | Gueble et al. | 333/202 |
| 5,034,711 | 7/1991 | Hendrick et al. | 333/49.1 |

FOREIGN PATENT DOCUMENTS

| | | | |
|---|---|---|---|
| 0044232 | 3/1980 | Japan | 333/235 |

*Primary Examiner*—Seungsook Ham

*Attorney, Agent, or Firm*—Hubbard, Thurman, Tucker & Harris

[57] ABSTRACT

A resonator mounting apparatus for use in a circuit (10) captively secures and positions a resonator (40) within a resonator cavity (15). The resonator mounting apparatus uses a pedestal (60) attached to the base (12) of the resonator cavity and a web support (50) attached to a cover (30) for the resonator cavity. Both the pedestal and the web support slip fit into corresponding holes in either the base or the cover. The distance between the pedestal and the web support is chosen to secure the resonator therebetween. The pedestal includes a resonator engagement means such as a peg (70) which extends into the resonator cavity to engage a complementary hole (42) in the resonator. Alternately, a circumferential lip (64) extends from the pedestal to engage the resonator. The web support is designed to flex when engaging the resonator. The resonator mounting apparatus is preferably assembled by an automated assembler without the use of glue or epoxy.

17 Claims, 2 Drawing Sheets

RESONATOR MOUNTING APPARATUS

TECHNICAL FIELD OF THE INVENTION

The present invention relates to apparatus for mounting a resonator used in the oscillator circuitry of a microwave communication system. More particularly, this invention concerns a microwave converter having resonator mounting apparatus with mechanical structure used to capture and position a dielectric resonator in a resonator cavity.

BACKGROUND OF THE INVENTION

Resonating circuits are important in microwave radar and communication circuits for generating, filtering and selecting frequencies in oscillators, amplifiers and tuners. Some microwave oscillators employ a small slab of dielectric material, referred to as a dielectric resonator, adjacent to an electrical conductor in order to create resonance at a selected frequency of current carried by the conductor. The resonant frequency of the dielectric resonator is dependent upon the geometry of the conductors in its vicinity. The resonant frequency of the dielectric resonator may be manually adjusted by altering the resonator's proximity or orientation with respect to the chamber within which it is located. Therefore, the apparatus for mounting a dielectric resonator within a resonator cavity is of primary importance.

Typically, the resonator is glued in position within the resonator cavity. For example, U.S. Pat. No. 4,963,841 to Sparagna discloses a "Dielectric Resonator Filter" in which a puck-shaped dielectric resonator is bonded directly to the base of the resonator cavity by a thin film of adhesive. The resonator is positioned by a plastic screw which engages a centrally located, threaded aperture in the resonator. The screw further engages a similar aperture in the base of the resonator cavity.

There are several problems with this prior art method. First, the epoxy or glue must cure before the part can be moved down the manufacturing line, thereby increasing manufacturing cycle time. Second, the epoxy thickness will vary, affecting the resonator frequency. Third, the dielectric constants of the resonators vary from lot to lot, requiring precise adjustments in resonator height. Such precise adjustments are difficult to accomplish with adhesives involved. Last, the application of adhesives is not easily accomplished in an automated procedure.

Mechanical means to constrain and position a resonator have also been developed. For example, U.S. Pat. No. 5,034,711 to Hendrick et al. discloses a "Dielectric Resonator Support System for a Waveguide". A dielectric resonator is held in position using support posts or rods. The support rods are made from a suitable dielectric material, and slip-fitted in holes provided at ninety degree intervals around the periphery of the dielectric resonator. The support rods are affixed to the waveguide, by gluing or being screwed in place. The support rods are slip-fitted such that they are allowed to expand, due to temperature, without being affixed to its supporting structure. However, placement of these rods and their connection to the resonator are delicate operations which are unsuitable for an automated assembly system.

Another example of mechanical resonator constraint means is disclosed in U.S. Pat. No. 4,939,489 to Gueble et al. entitled "Filter Having A Dielectric Resonator." This filter comprises at least one cylindrical cavity containing a cylindrical dielectric resonator whose axis of symmetry is collinear with the axis of the cavity. The resonator is held in a longitudinally asymmetrical position inside the cavity by a mandrel system which clamps around the cylindrical portion thereof and which includes at least one spoke for fixing it to said cavity while leaving play relative to said cavity. Again, however, this mandrel apparatus requires extensive manual installation and adjustment and is unsuitable for use in an automated process.

A need exists for an apparatus and method for mounting a resonator in a resonator cavity. The method should not require the use of epoxies or glues to constrain the resonator in position. The apparatus should allow for precise, positive placement of the resonator within the resonator cavity and yet be suitable for use in an automated assembly process. Such a resonator mounting system must also produce consistently desired resonator behavior.

SUMMARY OF THE INVENTION

The present invention provides a mechanical means to mount a dielectric resonator within a resonator cavity. The present mounting system allows for positive precise placement and constraint of the resonator in an assembly. The assembly can be produced through automation and does not utilize epoxies or glues.

The present resonator mounting system comprises two components within the resonator cavity: a pedestal and a web support. The pedestal is attached to the base of the cavity. In a preferred embodiment, this pedestal has a peg extending toward the base to provide for positive registration in the base. The pedestal has a generally smooth top surface and a resonator engagement means attached thereto. This resonator engagement means, in a preferred embodiment, is a peg extending toward the resonator cavity which complements a hole or indentation in the resonator, thus capturing the resonator. In another embodiment the pedestal has a circumferential lip configured to surround the periphery of the resonator. The pedestal is typically made from a plastic, such as crystal polystyrene, which has a coefficient of expansion closely matching the resonator material.

The web support is attached to the cover and extends toward the resonator cavity. The web support comprises a plurality of three support legs extending therefrom. Each leg engages in slip fit a web support hole in the cover. The platen has a first surface and second surface. The first surface acts as the resonator contact surface and is typically smooth. The second surface is typically grooved to allow the platen to flex. The web support is made of a material which is relatively elastic and has sufficient tensile strength so that it will not "set" and yet will accommodate the expansion of the resonator and the pedestal.

During assembly, the pedestal is attached to the resonator cavity base, and the web support is attached to the resonator cavity cover. The resonator is then positioned on the pedestal using resonator engagement means. The distance between the contact surface of the platen and the contact surface of the pedestal is predetermined to closely match the width of the resonator. Thus, when the resonator cavity cover is placed on the resonator cavity, the web support platen contacts a surface of the resonator, so as to hold it firmly in position.

BRIEF DESCRIPTION OF THE DRAWINGS

For a more complete understanding sent invention, and for further details and advantages thereof, reference is now made to the following detailed description taken in conjunction with the accompanying drawings, in which.

DETAILED DESCRIPTION OF THE PREFERRED EMBODIMENT

The present invention relates to resonator mounting apparatus that overcomes many of the disadvantages found in the prior art. This resonator mounting apparatus allows for the mechanical mounting of a dielectric resonator inside of a resonator cavity. The present invention eliminates the need for glue or epoxy in mounting the resonator, while enhancing rapid and precise placement of the resonator.

Figure 1:
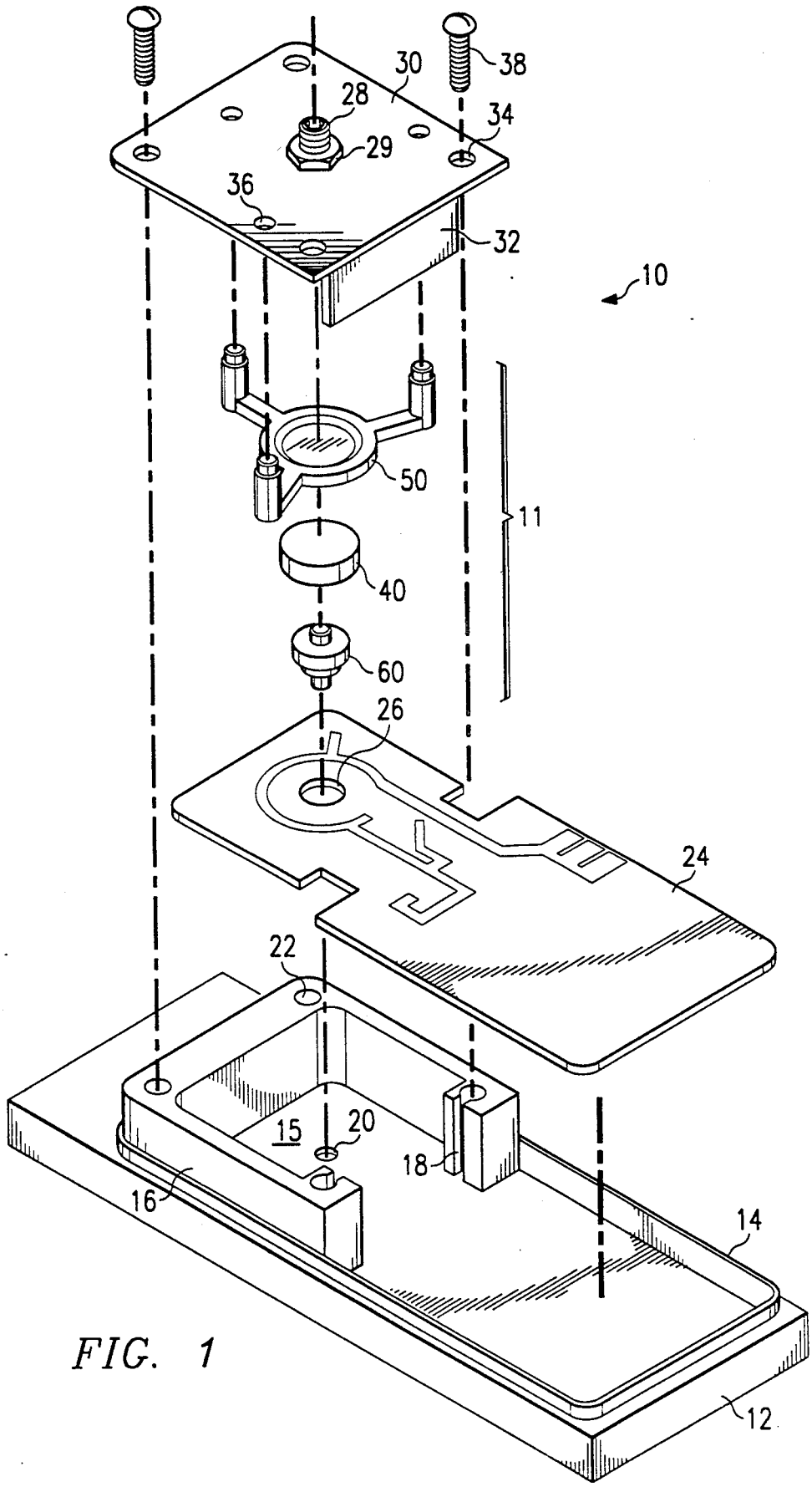
FIG. 1 is an exploded view of a preferred embodiment of the resonator mounting apparatus of the present invention.

Referring to FIG. 1, a preferred embodiment of the present invention is shown. Apparatus 10 is a low-noise block unit of a microwave down-converter including a resonator mounting structure 11. This mounting structure 11 comprises a web support 50 and a pedestal 60 to confine a resonator 40 in a fixed position within a resonator cavity 15.

Resonator cavity 15 is an element of a circuit located on circuit board 24 and is formed by rectangular cavity walls 16 positioned on a base 12. Circuit board 24 is dimensioned to be disposed within an area bounded by ridge 14 on base 12. The resonator cavity walls 16 form three sides of the cavity 15 in a relatively thick-walled enclosure also within the ridge 14.

The resonator cavity 15 is closed by a cover 30 with a closure portion 32. The closure portion 32 slides into guide grooves 18 in resonator cavity walls 16. The cover 30 is penetrated by attachment means holes 34 through which attachment means 38 pass to engage corresponding cavity holes 22. A set screw 28 is attached to cover 30 by nut 29 and extends through cover 30.

The web support 50 engages web support holes 36 in cover 30. A portion of pedestal 60 passes through a hole 26 in circuit board 24 and engages pedestal hole 20 in base 12. Thus, pedestal 60 positively registers circuit board 24 on base 12. The distance between the bottom surface of the web support 50 and the top surface of the pedestal 60 is predetermined so as to capture resonator 40 therebetween.

Figure 2:
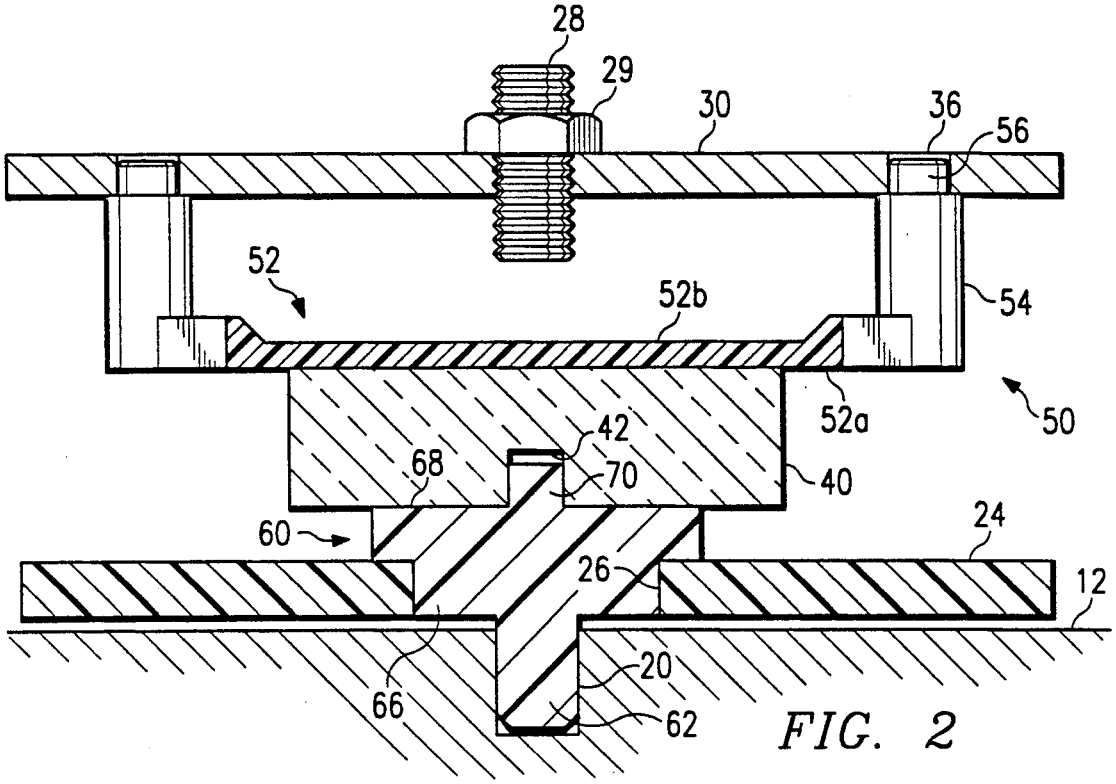
FIG. 2 is a sectional view of a preferred embodiment of the resonator mounting apparatus of FIG. 1.

FIG. 2 illustrates a preferred embodiment of the resonator mounting apparatus 11 shown in FIG. 1. As earlier described, resonator 40 is captured between pedestal 60 and web support 50. The pedestal 60 preferably has a centrally located first peg 62 extending towards the base 12 and configured to engage hole 20 in base 12. A pedestal portion 66 is also dimensioned to securely slip fit into circuit board hole 26. A second peg 70 extends from a surface 68 of pedestal 60 towards the resonator cavity 15 and into a complementary hole 42 in resonator 40. The resonator may also be configured to engage the entire surface 68 of pedestal 60. With either design, the resonator 40 is securely and positively placed on pedestal 60.

Web support 50 is also illustrated in greater detail. Web support 50 has a generally planar platen 52 adjacent to resonator 40. A plurality of legs 54 extend from platen 52 to engage cover 30. Typically, three legs 54 are used on web support 50. Each leg 54 has a reduced diameter peg 56 which securely slip fits into web support holes 36 of cover 30. Platen 52 has a first surface **52*a* and second surface 52*b*. The first surface 52*a* acts as a contact surface and is usually flat, while second surface 52*b* may be groove to create flexibility in platen 52**.

Once assembled, the frequency of the resonator cavity is adjusted by varying the penetration of set screw 28 through cover 30 into cavity 15. Once the appropriate tuning is established, bolt 29 is tightened against cover 30. The entire assembly does not use any form of glue or epoxy to secure the various elements.

Figure 3:
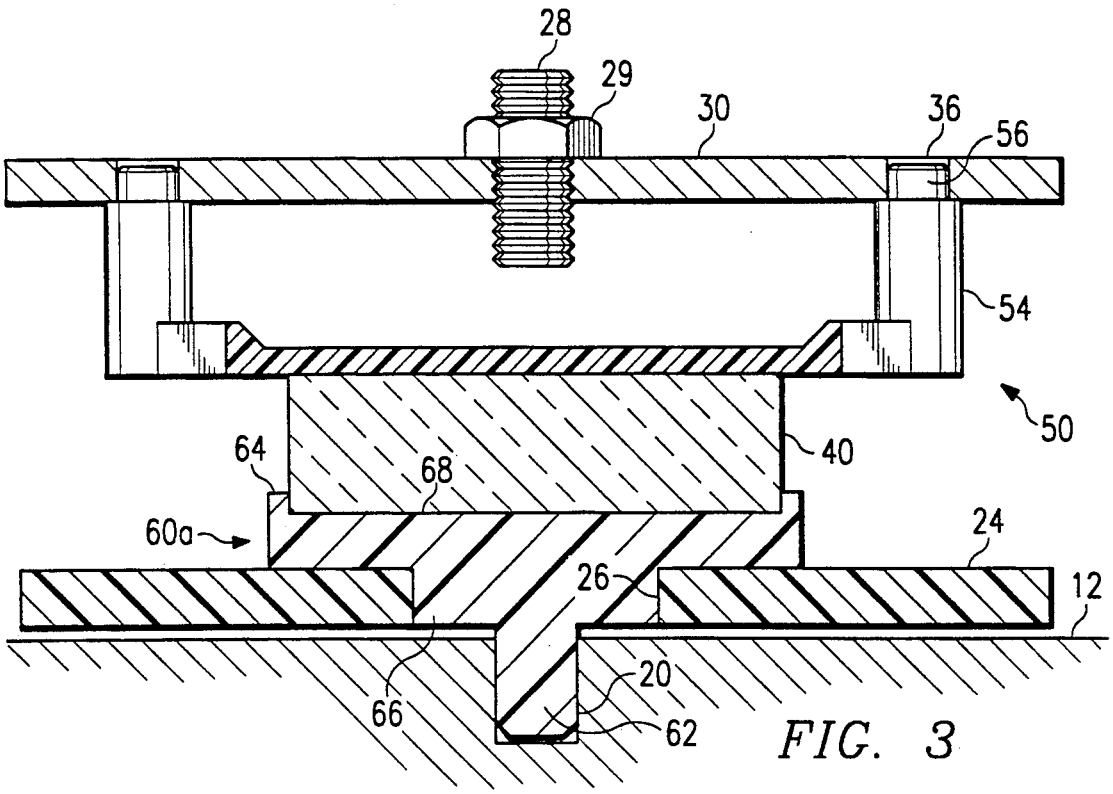
FIG. 3 is a sectional view of an alternative preferred embodiment of the resonator mounting apparatus of the present invention.

FIG. 3 illustrates another embodiment of the resonator mounting system. As in FIG. 2, a resonator 40 is positively captured between a pedestal **60*a* and a web support 50. However, the pedestal 60*a* differs from pedestal 60 in that it does not have a peg 70 extending towards the resonator cavity. Instead, pedestal 60 supports resonator 40 on support surface 68 bounded by a circumferential lip 64, the inner dimensions of which closely approximate the outer dimensions of resonator 40 to register with the periphery of resonator 40. Thus, the resonator 40 is positively positioned by lip 64**.

The pedestal **60*a* of FIG. 3 registers with the circuit board 24 and the base 12 in the same manner as in FIG. 2. Thus, a pedestal portion 66 extends towards the base 12 and is dimensioned to engage circuit board hole 26. A pedestal peg 62 extends towards the base 12 from pedestal portion 66 to engage hole 20 of base 12**.

Although preferred embodiments of the invention have been described and illustrated in the accompanying drawings, it will be understood that the invention is not limited to the embodiments disclosed but is capable of numerous rearrangements, modifications, and substitutions of parts and elements without departing from the spirit of the invention. Accordingly, the present invention is intended to encompass such rearrangements, modifications, and substitutions of parts and elements as full within the spirit of the scope of the invention.

I claim:

1. Resonator mounting apparatus for securing and positively positioning a resonator of predetermined width within a resonator cavity with a cover with a plurality of web support holes and a base with a pedestal engagement hole, said apparatus comprising:

(a) a pedestal removably attached to the base of said resonator cavity, said pedestal comprising:

(i) a primary pedestal portion with a first surface; and (ii) a base peg extending towards the base and configured to engage the pedestal engagement hole in the resonator cavity base;

(b) a web support removably secured to the cover of said resonator cavity, said web support comprising;

(i) a platen with a first surface and a second surface, the distance between the first surface of the platen and the first surface of the primary pedestal portion closely approximating the width of the resonator; and (ii) a plurality of support legs extending from the second surface of said platen, said support legs engaging web support holes in the resonator cavity cover; and (c) resonator engagement means comprising a resonator projection extending from said first surface of the primary pedestal portion, said resonator projection being configured to engage and register with the resonator.

2. The resonator mounting apparatus of claim 1 wherein the resonator engagement means comprises a resonator peg extending from the first surface of the primary pedestal portion to engage a corresponding hole in the resonator.

3. The resonator mounting apparatus of claim 1 wherein said resonator engagement means comprises a circumferential lip on the first surface of the primary pedestal portion, said circumferential lip being configured to engage the periphery of the resonator.

4. The resonator mounting apparatus of claim 1 wherein said pedestal engages said resonator cavity base in slip fit.

5. The resonator mounting apparatus of claim 1 wherein said web support engages said resonator cavity cover in slip fit.

6. Resonator mounting apparatus for securing and positioning a resonator of predetermined width within a resonator cavity having a cover and a base, said apparatus comprising:

(a) a first support disposed on the base of said resonator cavity and having a surface facing the resonator cavity, including first register means on said first support for engaging one side of the resonator, wherein said first register means comprises a peg extending from the first support; and (b) a second support disposed on the cover of said resonator cavity and having second register means facing the resonator cavity for engaging a second side of the resonator such that the distance between the second register means of the second support and the surface of the first support closely approximates the predetermined width of the resonator.

7. The resonator mounting apparatus of claim 6 wherein the first support means is a pedestal on the base and the second support means is a web support on the cover.

8. The resonator mounting apparatus of claim 7 wherein said pedestal engages said resonator cavity base in slip fit.

9. The resonator mounting apparatus of claim 7 wherein said web support engages said resonator cavity cover in slip fit.

10. Resonator mounting apparatus of securing and positioning a resonator of predetermined width within a resonator cavity having a cover and a base, said apparatus comprising:

(a) a pedestal disposed on the base of said resonator cavity and having a surface facing the resonator cavity, wherein said pedestal comprises a primary pedestal portion, and a base peg extending toward the base from said primary pedestal portion and configured to engage a hole in the resonator cavity base; and (b) a web support disposed on the cover of said resonator cavity and having a surface facing the resonator cavity such that the distance between the surface of the web support and the surface of the pedestal closely approximates the predetermined width of the resonator.

11. Resonator mounting apparatus for securing and positioning a resonator of predetermined width within a resonator cavity having a cover and a base, said apparatus comprising:

(a) a pedestal disposed on the base of said resonator cavity and having a surface facing the resonator cavity; and (b) a web support disposed on the cover of said resonator cavity and having a surface facing the resonator cavity such that the distance between the surface of the web support and the surface of the pedestal closely approximates the predetermined width of the resonator, wherein said web support comprises a platen with a first surface facing toward the cavity and a second surface facing toward the resonator cavity cover, and a plurality of support legs extending from the second surface of said platen, said support legs engaging web support holes in the cover.

12. The resonator mounting apparatus of claim 11 wherein said second surface of said platen is grooved.

13. Resonator mounting apparatus for securing and positioning a resonator of predetermined width within a resonator cavity having a cover and a base, said apparatus comprising:

(a) a pedestal disposed on the base of said resonator cavity and having a surface facing the resonator cavity; and (b) a web support disposed on the cover of said resonator cavity and having a surface facing the resonator cavity such that the distance between the surface of the web support and the surface of the pedestal closely approximates the predetermined width of the resonator; and (c) resonator engagement means attached to said pedestal for registering the resonator relative to the pedestal, wherein said resonator engagement means comprises a resonator peg extending from the surface of the pedestal facing the resonator, said resonator peg being configured to engage a complementary hole in the resonator.

14. Resonator mounting apparatus for securing and positioning a resonator of predetermined width within a resonator cavity with a cover and a base, said apparatus comprising:

(a) a pedestal removably attached to the base of said resonator cavity and extending into the resonator cavity, wherein said pedestal comprises a primary pedestal portion, and a base peg extending from said primary pedestal portion toward the base and configured to engage a hole in the resonator cavity base;

(b) a web support removably secured to the cover of said resonator cavity and extending into the resonator cavity, such that the distance between the web support and the pedestal closely approximates the predetermined width of the resonator; and (c) resonator engagement means attached to said pedestal for engaging the resonator relative to the pedestal.

15. Resonator mounting apparatus for securing and positioning a resonator of predetermined width within a resonator cavity with a cover and a base, said apparatus comprising:

(a) a pedestal removably attached to the base of said resonator cavity and extending into the resonator cavity;

(b) a web support removably secured to the cover of said resonator cavity and extending into the resonator cavity, such that the distance between the web support and the pedestal closely approximates the predetermined width of the resonator, wherein said web support comprises a platen with a first surface and a second surface and at least three support legs extending from the second surface of said platen, said support legs engaging web support holes in the resonator cavity cover; and (c) resonator engagement means attached to said pedestal for engaging the resonator relative to the pedestal.

16. Resonator mounting apparatus for securing and positioning a resonator of predetermined width within a resonator cavity with a cover and a base, said apparatus comprising:

(a) a pedestal removably attached to the base of said resonator cavity and extending into the resonator cavity;

(b) a web support removably secured to the cover of said resonator cavity and extending into the resonator cavity, such that the distance between the web support and the pedestal closely approximates the predetermined width of the resonator; and (c) resonator engagement means attached to said pedestal for engaging the resonator relative to the pedestal, wherein said resonator engagement means comprises a resonator peg extending from a surface of the pedestal facing the resonator, said resonator peg being configured to engage a complementary hole in the resonator.

17. Resonator mounting apparatus for securing and positioning a resonator of predetermined width within a resonator cavity having a cover and a base, said apparatus comprising:

(a) a pedestal disposed on the base of said resonator cavity and having a surface facing the resonator cavity; and (b) a web support disposed on the cover of said resonator cavity and having a surface facing the resonator cavity such that the distance between the surface of the web support and the surface of the pedestal closely approximates the predetermined width of the resonator, wherein said web support comprises a platen with a first surface facing toward the cavity and a second surface facing toward the resonator cavity cover, and a plurality of support legs extending from the second surface of said platen, said support legs engaging web support holes in the cover, and wherein said second surface of said platen is grooved.

* * * * *